United States Patent [19]

Wiig

[11] Patent Number: 4,561,582

[45] Date of Patent: Dec. 31, 1985

[54] STRIP FEEDERS

[75] Inventor: Chester M. Wiig, Lincolnwood, Ill.

[73] Assignee: F. J. Littell Machine Co., Chicago, Ill.

[21] Appl. No.: 401,608

[22] Filed: Jul. 26, 1982

[51] Int. Cl.[4] ..... B65H 17/22

[52] U.S. Cl. ..... 226/142; 226/154; 226/158

[58] Field of Search ..... 226/154, 142, 158, 138, 226/139, 136, 124, 141, 147, 152, 149; 74/75; 83/236

[56] References Cited

U.S. PATENT DOCUMENTS

| | | | |
|---|---|---|---|
| 1,821,899 | 9/1931 | Schneider | 226/154 X |
| 1,831,264 | 11/1931 | Schneider | 226/154 X |
| 2,262,915 | 11/1941 | Bobst | 226/142 |
| 2,514,261 | 7/1950 | Scheffey | 226/154 X |
| 3,483,782 | 12/1969 | Eyberger | 226/154 X |
| 3,638,846 | 2/1972 | Wiig | 226/142 |
| 3,650,449 | 3/1972 | Mundus | 226/142 |
| 3,758,011 | 9/1973 | Portmann | 226/142 |
| 3,784,075 | 1/1974 | Portmann | 226/154 X |
| 4,029,251 | 6/1977 | Johnson | 226/154 |
| 4,138,913 | 2/1979 | Gentile | 83/236 |
| 4,285,453 | 8/1981 | Flamme et al. | 226/142 |
| 4,316,569 | 2/1982 | Gentile | 226/158 |

FOREIGN PATENT DOCUMENTS

| | | | |
|---|---|---|---|
| 551966 | 11/1956 | Italy | 226/154 |

*Primary Examiner*—Harvey C. Hornsby
*Assistant Examiner*—Scott J. Haugland
*Attorney, Agent, or Firm*—Willian Brinks Olds Hofer Gilson & Lione Ltd.

[57] ABSTRACT

An improvement in a strip feeder for feeding a continuous strip of sheet material to a punch press, for example. The feeder includes a drive roller segment and an idler roller. The drive roller segment is driven in oscillating fashion by the punch press through a cam oscillator drive. A lever assembly connects the cam drive with the drive roller segment shaft. The lever assembly includes a lever which pivots about a point adjustable along the length of the lever. This adjustment, which can be made while the feeder is in operation, is effective to vary the oscillating travel of the feed roller segment and, accordingly, the length of strip which is fed.

6 Claims, 8 Drawing Figures

FIG. 7
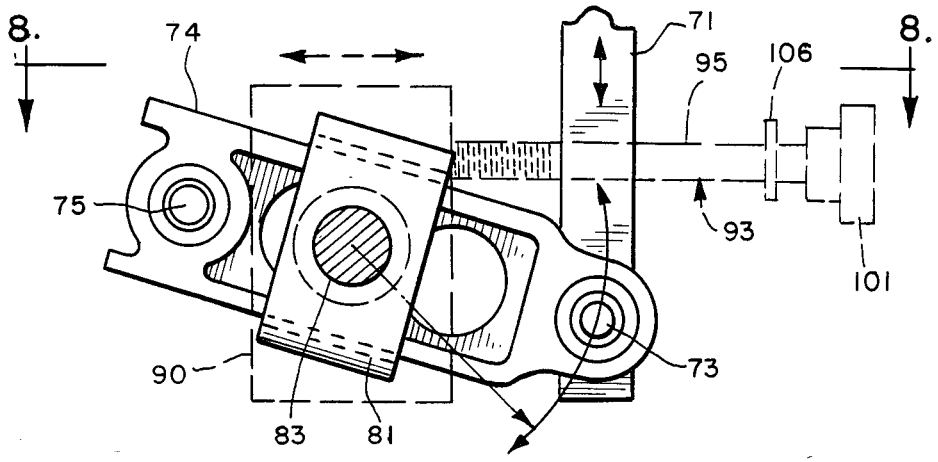
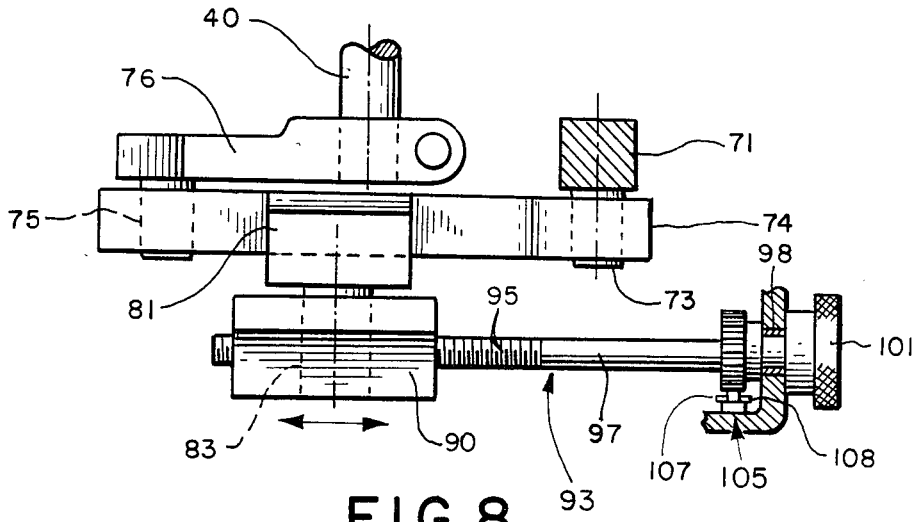
FIG. 8

STRIP FEEDERS

FIELD OF THE INVENTION

This invention relates generally to feeders for strip material. It relates particularly to apparatus for feeding strip material in the form of metal or plastic, for example, to a punch press or the like.

BACKGROUND OF THE INVENTION

Strip feeders of widely varying construction and capabilities are old and well known in the material handling art. They find particularly advantageous application as feeders for punch presses. It is conventional with a punch press, for example, for such a feeder to intermittently advance a metal strip for a predetermined distance through the press. Between each feed cycle, while the strip is stationary, the press is effective to perform a working operation on the strip, i.e., punch out an electrical terminal, for example.

Feeders are conventionally driven by a press in timed relationship to its punching operation. Early strip feeders employed clutches and brakes to control the feed. Direct drive feeders were then developed which eliminated clutches and brakes in favor of cam mechanisms, such as illustrated in the Portmann U.S. Pat. No. 3,784,075, or index mechanisms, such as illustrated in Eyeberger U.S. Pat. No. 3,483,782, for example.

These strip feeders conventionally provided for adjustment of the length of strip fed in each feed cycle. In the Eyeberger patent construction, for example, the feed length is adjusted by changing the size of the idler sprocket 30.

With known feeders the feeder and the punch press must be shut down while the feed length is changed. The feed length adjustment process is time consuming and costly in terms of lost production. With feeders such as illustrated in the Eyeberger patent a different sprocket arrangement must be inventoried for each feed length desired.

SUMMARY OF THE INVENTION

An object of the present invention is to provide an improvement in strip feeders. Another object is to provide a strip feeder whose operating mechanism permits simple and fast adjustment of the strip length being fed. Still another object is to provide a mechanism which permits adjustment of the feed length during operation of the feeder. Yet another object is to provide a mechanism which permits an infinite number of length adjustments between predetermined limits. A further object is to provide a mechanism which permits minute, incremental adjustments in feed length and locks each adjustment in place to prevent change during operation.

The foregoing and other objects are realized in accord with the present invention by providing a strip feeder which intermittently feeds a continuous strip of metal, for example, to a punch press. Between each strip feed movement the press punches a part out of the temporarily motionless strip.

A belt drive from the press continuously rotates the feeders input shaft. A cam operated, oscillator drive transmission translates the continuous, unidirectional input shaft rotation into a continuous, oscillatory output shaft rotation. In the preferred embodiment the output shaft oscillates back and forth through an arc of 60° at non-uniform rate.

The output shaft is connected through a drive arm, a connecting rod and a drive lever to a feed roll segment. The feed roll segment is caused to oscillate back and forth by oscillation of the output shaft. The feed roll segment cooperates with an idler roller to intermittently drive the strip through the punch press.

According to the invention the amount of arcuate travel of the feed roll segment, which determines the amount of strip which is fed to the press, is controlled by adjusting the effective pivot axis of the drive lever in its drive train. This is accomplished readily while the press is in operation and adjustment can be made to an infinite number of positions between the outer limits of travel of the cam segment. Furthermore, the newly adjusted feed length is automatically locked once it is set so that no creepage occurs.

BRIEF DESCRIPTION OF THE DRAWING

The invention, including its construction and method of operation, together with additional objects and advantages thereof is illustrated more or less diagrammatically in the drawings, in which:

FIG. 7 is a sectional view taken along line 7—7 of FIG. 6; and

FIG. 8 is a sectional view taken along line 8—8 of FIG. 7.

DESCRIPTION OF THE PREFERRED EMBODIMENT

Figure 1:
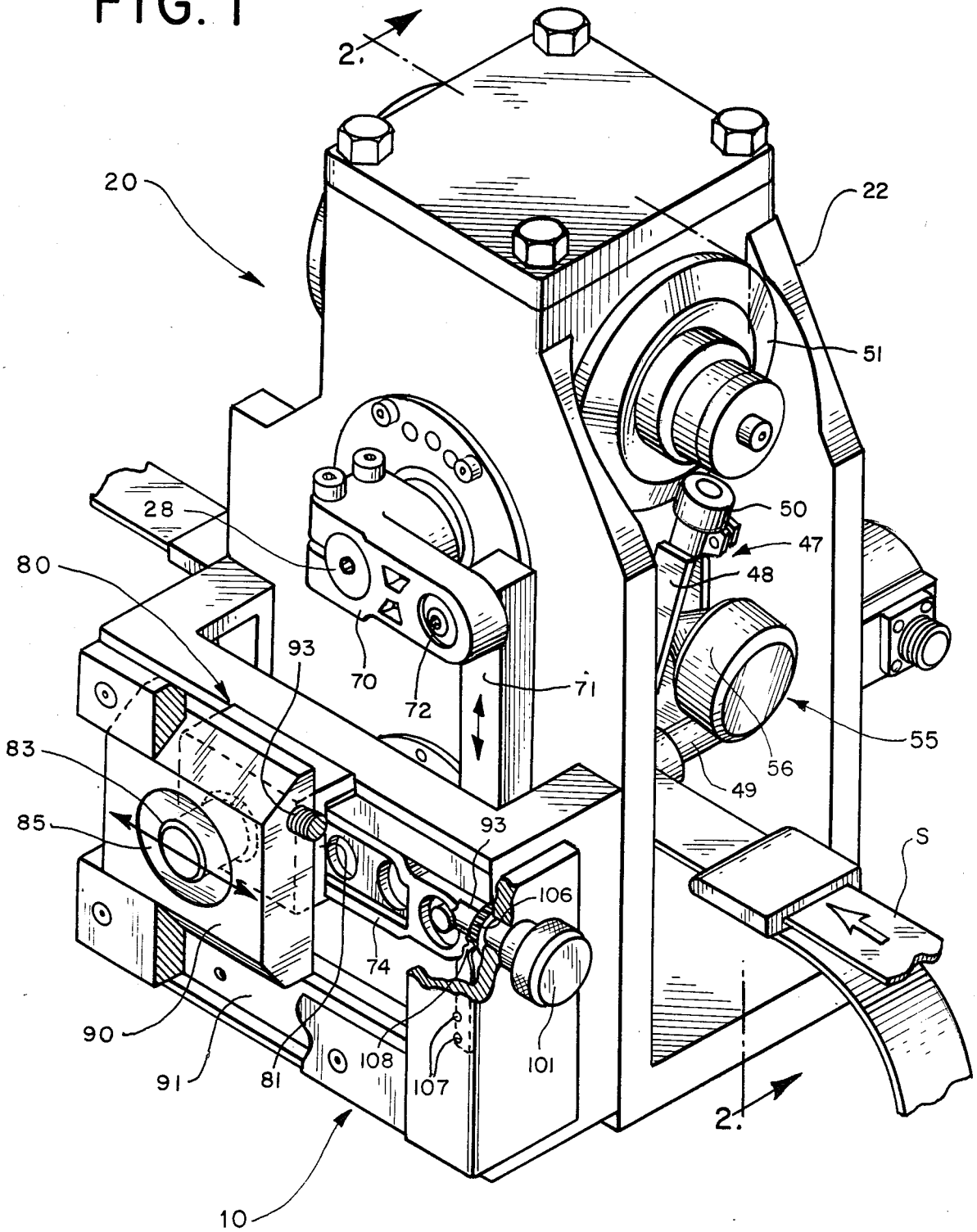
FIG. 1 is a perspective view of the feeder with parts broken away.
Figure 2:
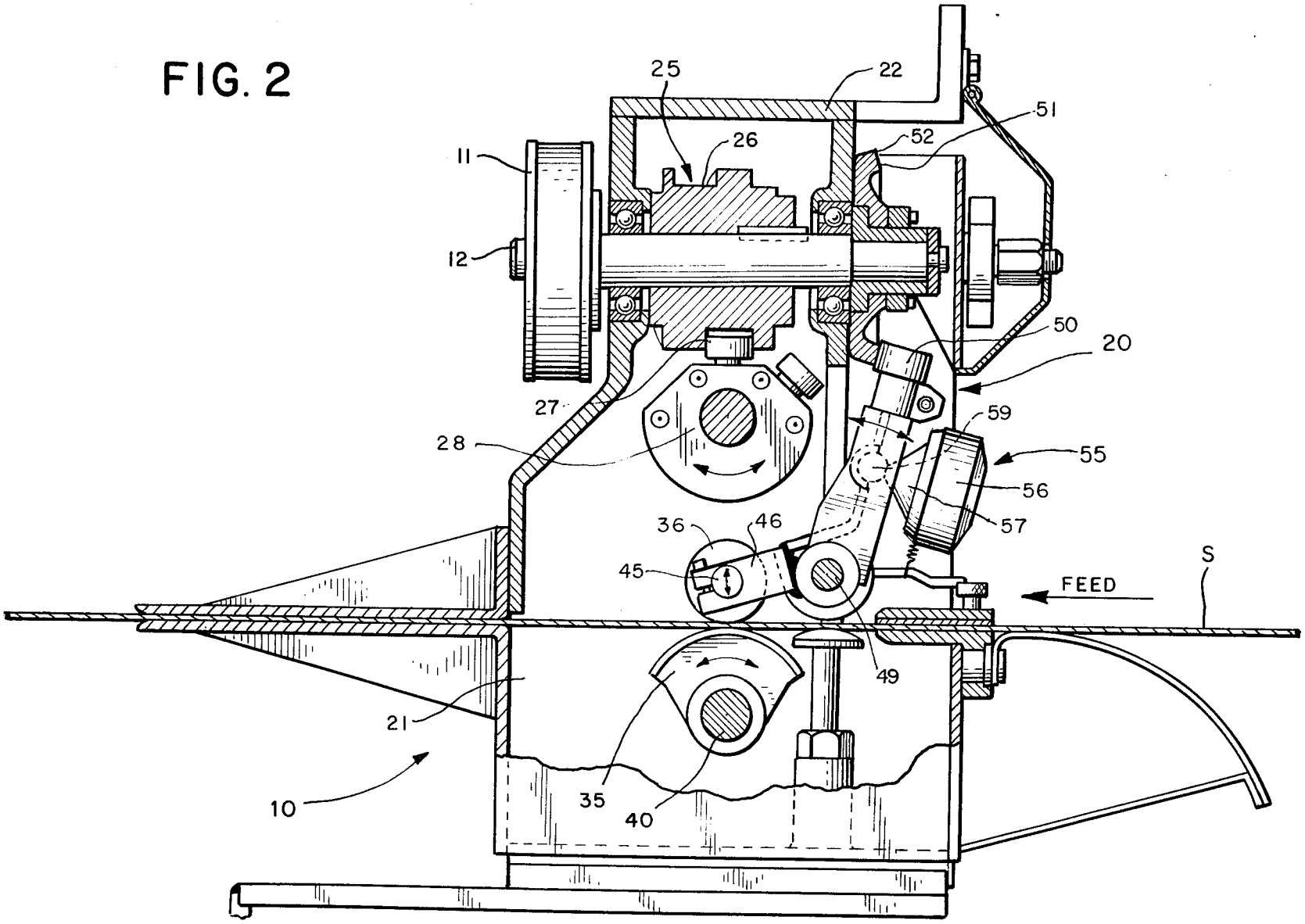
FIG. 2 is a front elevational view of the feeder of FIG. 1, partially in section.

Referring now to the drawings, and particularly to FIGS. 1 and 2, a strip feeder for a punch press (not shown) is illustrated generally at 10. The strip feeder 10 intermittently feeds a continuous strip of metal S to the punch press. Between each strip S movement the press punches a part out of the temporarily motionless strip in a well known manner.

The punch press operates continuously. The strip feeder 10 is driven off the continuously rotating crank shaft (not shown) of the press in timed relation to the operation of the dies in the punch press. A conventional belt drive connection from the crank shaft of the punch press to the belt drive pulley 11 of the strip feeder 10 is effective to rotate the input shaft 12 of the strip feeder.

The strip feeder 10 is generally of the cam operated type illustrated and described in the aforementioned Portmann patent. The feeder 10 translates the continuous and uniform rotation of the input shaft 12 into intermittent, cyclical feed of the strip S to the punch press. The feeder 10 advances the strip S during a feed stroke and then releases it so that the press can perform its punching operation while the strip is motionless. According to the present invention the amount of strip material S which is advanced to the feeder 10 is adjustable during operation of the feeder.

The strip feeder 10 comprises a cast metal housing 20 which includes a lower housing portion 21 and an upper housing portion 22. The input shaft 12 extends horizontally into the upper housing portion 22, as illustrated.

Figure 4:
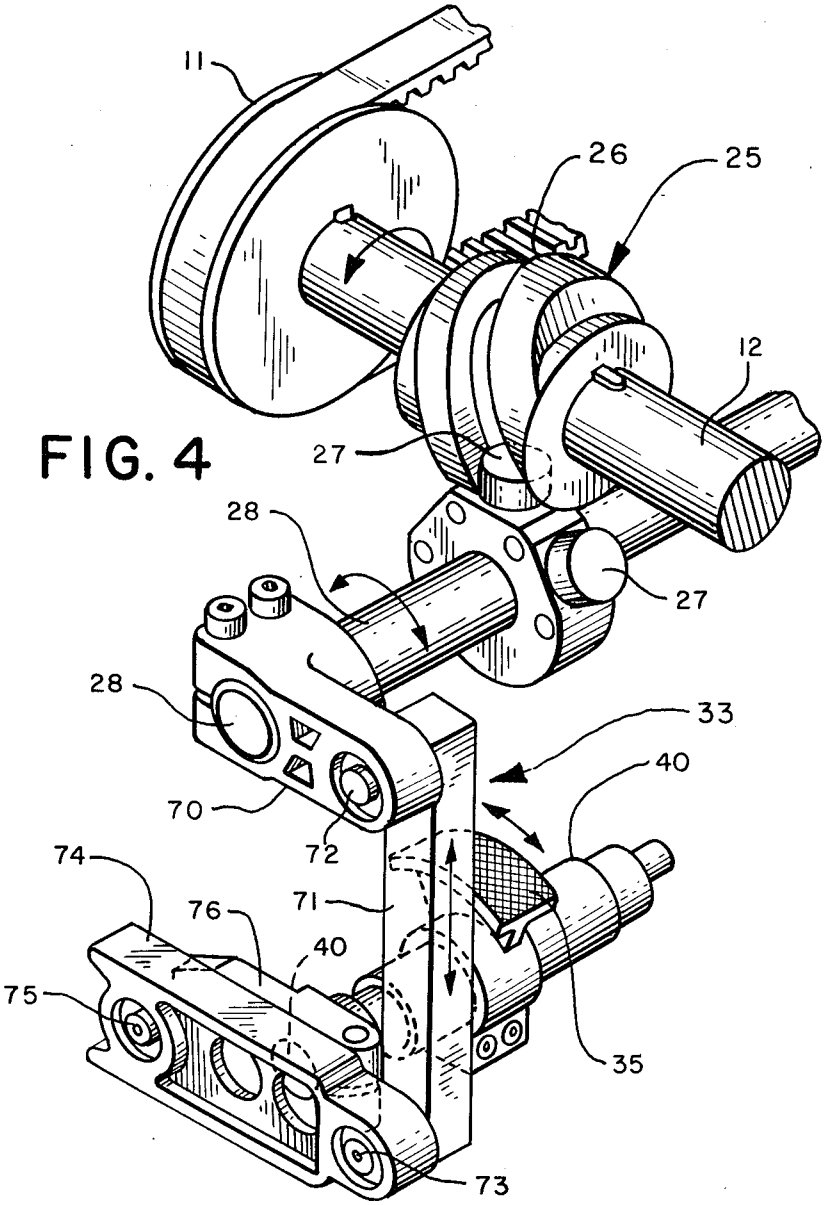
FIG. 4 is a perspective view of another portion of the feeder's operating mechanism, specifically the oscillator drive mechanism.

Within the upper housing portion 22 the shaft 12 extends through a conventional Camco oscillator drive transmission 25. As seen in FIG. 4, the transmission 25 includes a sleeve mounted ring cam 26 which is fixed to the shaft 12 and rotates with it. The ring cam 26 rides between disc mounted cam follower rollers 27 fixed on an output shaft 28 of the transmission 25. The output shaft 28 extends perpendicular to the input shaft 12 and, like the shaft 28, is disposed in horizontal relationship.

Rotation of the input shaft 12 at a uniform, continuous rate, produces oscillation of the output shaft 28 at a non-uniform, discontinuous rate, in a manner which is conventional. The transmission 25 is designed so that during the feed stroke of the feeder 10 the output shaft 28 rotates in a counter clockwise (CCW) direction, as viewed from the left in FIG. 4. During the return stroke of the feeder 10 the shaft 28 rotates in a clockwise (CW) direction. In other words, the shaft 28 oscillates. The transmission 25 is designed so that this oscillation is through an arc of 60°, although a greater arc might be provided for.

One complete feed cycle of the feeder 10 involves rotation of the shaft 28 in a CCW direction through an arc of 60°. The shaft 28 hesitates for a moment and then rotates in a CW direction through an arc of 60°, returning to its starting point. There it hesitates for a moment before the feed cycle is repeated.

Figure 3:
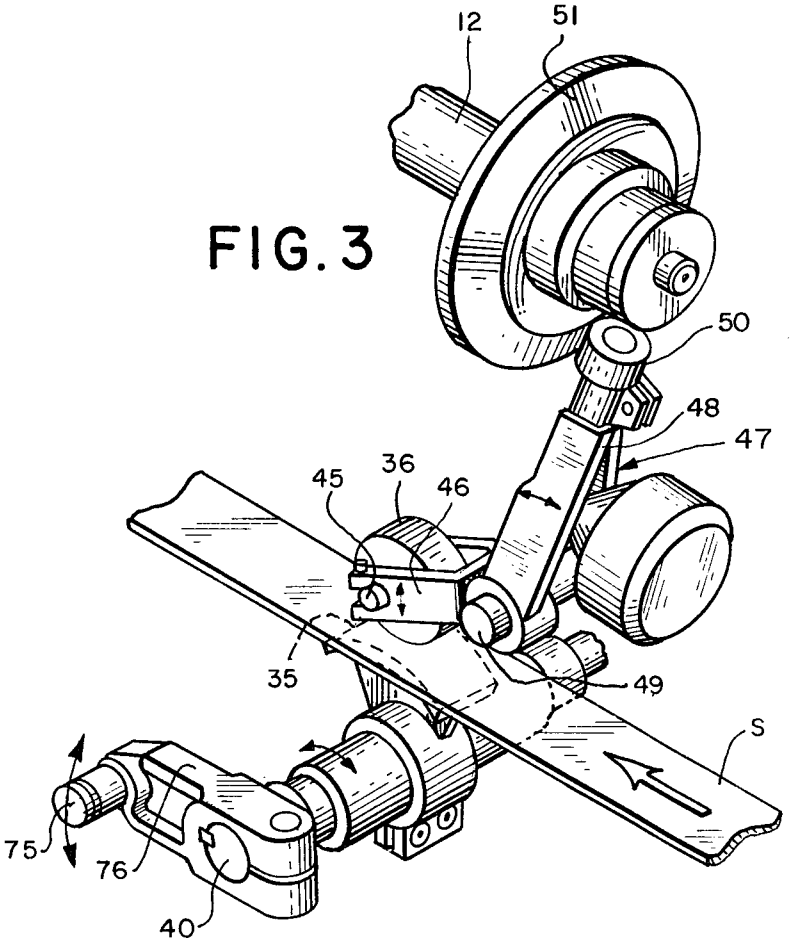
FIG. 3 is a perspective view of a portion of the feeder's operating mechanism, specifically the strip feed roller assembly.

Referring now also to FIG. 3, the strip S is physically driven through the feeder 10 by its feed rolls 35 and 36, the former being a drive roll segment and the latter being an idler roll. Oscillation of the shaft 28 is effective, through a drive train seen generally at 33 to oscillate the drive roll segment 35. The drive roll segment 35 and the idler roll 36 cyclically grip the strip S and drive it through the punch press.

Figure 5:
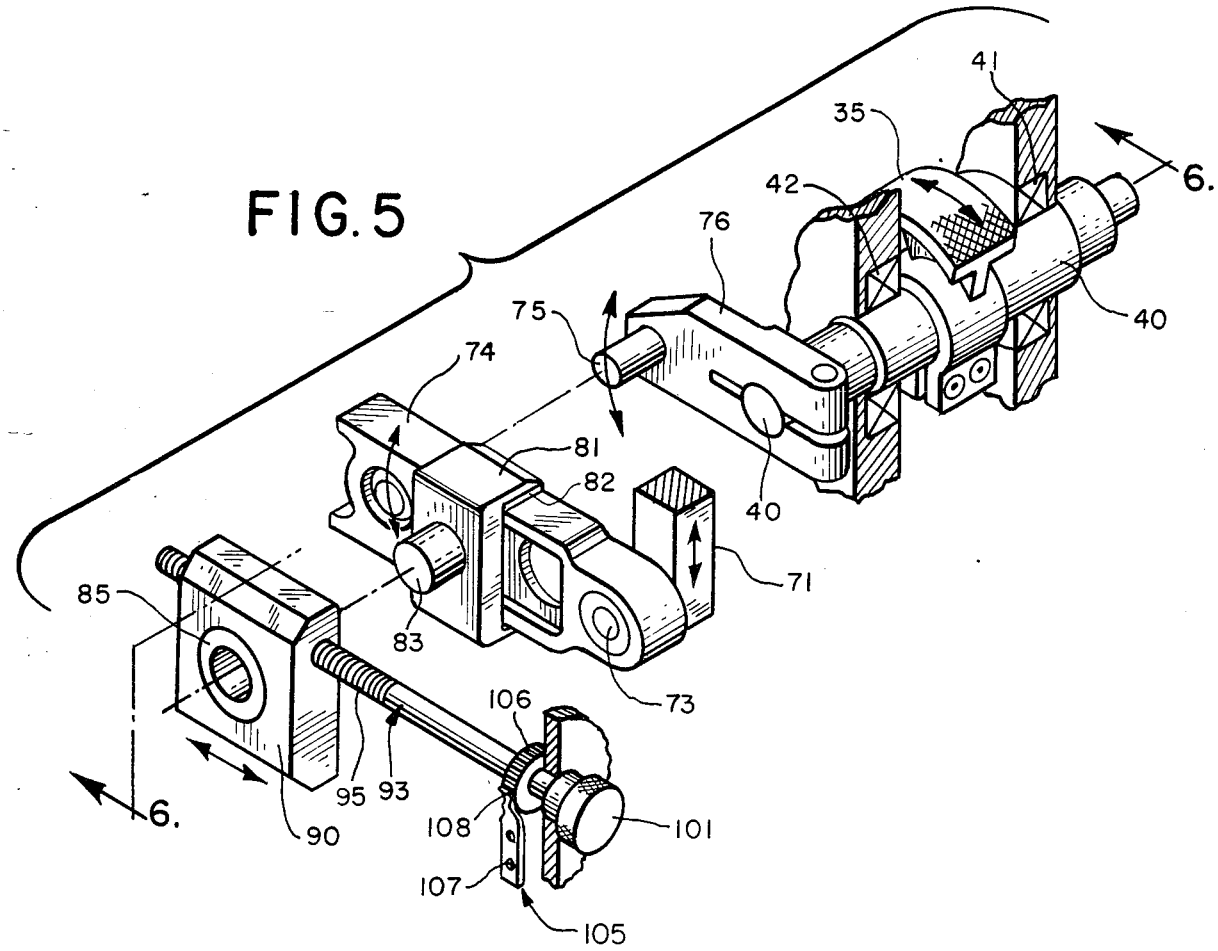
FIG. 5 is an exploded perspective view of the feed adjustment assembly for the feeder.
Figure 6:
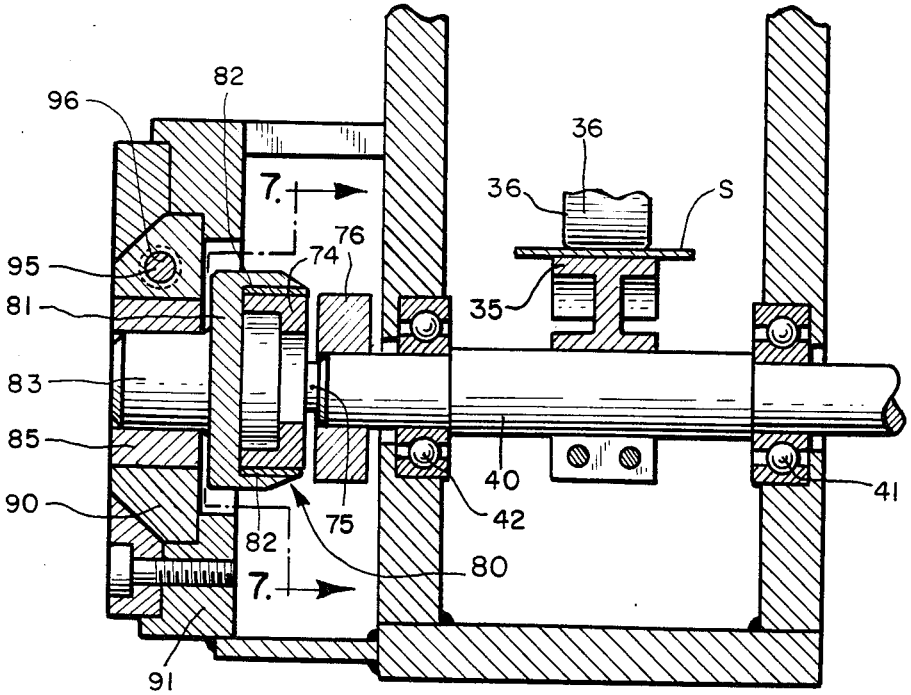
FIG. 6 is a sectional view taken along line 6—6 of FIG. 5.

The drive roll segment 35 is fixed to a drive roll shaft 40 mounted in the housing 20 directly below the aforedescribed transmission output shaft 28. The drive roll shaft 40 extends parallel to the output shaft 28 in vertical alignment with it, as best seen in FIG. 4. The drive roll shaft 40 is journaled in the housing in bearings 41,42 as seen in FIG. 5.

The idler roller 36 is mounted for free rotation about an idler roller shaft 45 which extends parallel to the drive roll shaft 40 and is disposed between the shaft 40 and the output shaft 28. The idler roller shaft 45 is mounted between parallel feet 46 of an L-shaped rocker arm 47, as seen in FIGS. 1 and 3.

The rocker arm also includes upwardly converging legs 48. Between the feet 46 and legs 48 the rocker arm 47 is journaled on a rocker arm shaft 49 for rocking movement about the shaft.

At their upper ends the legs 48 mount a cam roller 50. The cam roller 50 engages a cam ring 51 fixed to the end of the input shaft 12 inside the upper housing portion 22 opposite the drive pulley 11. The roller 50 rides on the cam surface 52.

The shaft 12 rotates in timed relationship with the operation of the press (not shown), as has been pointed out. The rotating cam surface 52 is designed so that it controls rocker arm 47 movement and permits the idler roll 36 to grip the strip S against the drive roll segment 35 during the feed stroke of the feeder 10.

At the end of the feed stroke the cam surface 52 forces the rocker arm 46 to raise the idler roll 36 off the strip S, releasing it. The press then performs its punching operation. During the punching operation the drive roll segment 35 oscillates back to its starting point.

The rotating cam surface 52 then permits the rocker arm 47 to again move the idler roll 36 downwardly and grip the strip S against the roll segment 35. The feeder 10 is ready to begin another feed cycle.

The rocker arm 47 is journaled on the shaft 49, as has been pointed out. An air pressure cylinder unit 55 mounted inside the upper housing portion 22 constantly seeks to rotate the arm 46 in a CW direction about the shaft 49, as seen in FIG. 7. As such, the cam roller 50 is urged into engagement with the cam surface 52 on the cam ring 51.

The air pressure cylinder unit 55 includes a cylinder 56 in which a cup shaped piston 57 is mounted for movement under the influence of air pressure introduced to the cylinder through input port 58. The piston 57 has a ball joint 59 formed at its outermost end, i.e., at the base of the cup. The ball joint 59 is seated in a socket 63 mounted between the legs 48 of the rocker arm 47.

Air under a pressure of 25–40 psi is introduced to the cylinder 56 as long as the feeder 10 is operating. It is this air pressure which provides the gripping force for the idler roll 36 to press the strip S against the feed roll segment 35. The force is cyclically overcome by the rotating cam surface 52 to move the idler roll 36 away from the strip S after each feed stroke of the feed roll segment 35.

As has been pointed out, it is oscillation of the transmission output shaft 28 which, through the drive train 33, rotates the feed roll segment 35 back and forth. In turn, it is the angular degree of oscillation of the segment 35 which determines the length of strip S which is fed, i.e., the length of the feed stroke. According to the present invention the degree of oscillation of the drive roll segment 35 is adjustable during operation of the feeder 10.

As best seen in FIGS. 4 and 8, the drive train, which has previously been identified generally at 33, includes a drive arm 70 affixed to the transmission output shaft 28. The drive arm 70 is disposed generally horizontally in the upper housing portion 22 and oscillates through the aforementioned 60° arc with the shaft 28.

A connecting rod 71 is pivotally connected to the free end of the drive arm 70 at 72 and depends from it. The lower end of the connecting rod 71 is, in turn, pivotally connected at 73 to a generally horizontal outer drive lever 74. The opposite end of the drive lever 74 is pivotally connected, at 75, to one end of an inner drive lever 76. The other end of the inner drive lever 76 is fixed to one end of the shaft 40 on which the drive roll segment 35 is mounted.

Mounted on the outside of the outer drive lever 74, for sliding moving along the lever, is a pivot bearing 80. The pivot bearing 80 includes a channel member 81 which seats the lever 74 between slide bearings 82. The pivot bearing 80 also includes a stub shaft 83 which extends horizontally of the channel member 81 and seats in a bearing block 85.

The bearing block 85 is mounted for horizontal sliding movement in a slide fixture 90 mounted in the housing 20 on a side wall 91 of the lower housing portion 22. The bearing block 85 and, accordingly, the pivot bearing 80 can be moved in opposite directions along the slide fixture 90 by a screw adjustment assembly 93.

It will be seen that as the feeder is operated the connecting rod 71 moves up and down through a fixed distance determined by the angular movement of the shaft 28 (60°) and the length of the arm 70. The end 73 of the outer drive lever 74 moves up and down correspondingly.

The outer drive lever 74 is thus caused to pivot in oscillating fashion about the axis of the stub shaft 83. If the pivot bearing 80 is positioned at the midpoint of the outer drive lever 74 the opposite end 75 of the lever 74 moves vertically a distance equal to the vertical movement of the one end 73.

If the pivot bearing 80 is moved toward the opposite end 75 of the lever 74 by manipulation of the screw adjustment assembly 93 the vertical travel of that end 75 of the lever 74 is diminished. Theoretically, movement of the pivot bearing 80 all the way to the other end 75 of the lever 74 would result in no vertical travel of the lever at that end. In practice, the pivot bearing 80 has a permissible travel path short of that limit.

The screw adjustment assembly 93, through which adjustment of the bearing block 85 is effected, includes an externally threaded shaft 95. The inner end of the shaft 95 is threaded into an internally threaded bore 96 in the block 85. The outer end of the shaft 95 has an unthreaded section 97 which is journaled in a sleeve bearing 98 mounted on the lower housing portion 21 of the feeder housing 20.

At the free outer end of the shaft 95, which protrudes from the housing 20, an adjustment knob 101 is affixed to the shaft. Rotation of the shaft 95 by means of the knob 101 moves the block 85 and thus adjusts the feed length.

Each time the shaft 95 is rotated to adjust feed length a detent mechanism 105 holds the shaft in the new set position. The detent mechanism includes a ring gear 106 on the shaft 95 immediately inside the housing 20. A leaf spring 107 mounted in the housing 20 engages the ring gear 106 with a detent finger 108. The finger 108, resiliently urged against the ring gear 107, holds the gear and thus the shaft against inadvertent movement once it is positively set.

While the embodiment described herein is at present considered to be preferred, it is understood that various modifications and improvements may be made therein, and it is intended to cover in the appended claims all such modification and improvements as fall within the true spirit and scope of the invention.

What is desired to be claimed and secured by Letters Patent of the United States is:

1. In a strip feeder for feeding a continuous strip of material to a punch press or the like, the improvement comprising:

(a) cam means mounted for rotation in one direction on an input shaft;
(b) an output shaft;
(c) cam follower means mounted on said output shaft and adapted to follow said cam means and as it rotates with said input shaft whereby said output shaft is caused to oscillate through a precisely predetermined arc;
(d) a drive arm mounted on said output shaft for oscillation therewith;
(e) a first drive lever mounted for pivotal movement on a pivot shaft;
(f) means pivotally interconnecting corresponding ends of said drive arm and said first drive lever;
(g) a second drive lever extending generally parallel to said first drive lever;
(h) said first and second drive levers being pivotally interconnected at one point;
(i) said second drive lever being fixed to a strip drive roll shaft at a point displaced from said one point whereby movement of said second drive lever at said one point is effective to rotate said drive roll shaft in one direction or the other;
(j) said pivot shaft being movable parallel to said first drive lever to vary its operative length; and
(k) control means for moving said pivot shaft whereby the operative length of said first drive lever is varied and the arc of travel of said drive roll shaft is correspondingly varied.

2. The improvement in a strip feeder of claim 1 further characterized in that:

(a) said output shaft extends perpendicular to said input shaft.

3. The improvement in a strip feeder of claim 1 further characterized by and including:

(a) an idler roller for cooperating with said strip drive roll to grip said strip and feed it for a predetermined distance;
(b) cam operated lift means effective to intermittently lift said idler roller away from said drive roller; and
(c) said cam operated lift means including cam means driven by said input shaft.

4. In a strip feeder for feeding a continuous strip of material to a punch press or the like, the improvement comprising:

(a) an input shaft;
(b) an output shaft;
(c) transmission means connecting said shafts in locked, anti-backlash relationship, so that rotation of the input shaft at a uniform, continuous rate, produces oscillation of the output shaft at a non-uniform, discontinuous rate;
(d) means for gripping said strip and feeding it for a predetermined distance;
(e) said grippping means comprising an idler roller and a drive segment with an arcuate drive surface;
(f) said drive segment being mounted on the axis of its arc for oscillating movement on that axis;
(g) means connecting said output shaft and said drive segment for oscillating said drive segment, including a drive arm connected to said output shaft and a drive lever connected to said drive segment with rod means interconnecting them;
(h) said drive lever having a pivot axis movable between its opposite ends; and
(i) control means for controlling the arc of travel of said drive surface during operation of said strip feeder;
(j) said control means being effective to move said pivot axis between said opposite ends whereby the operative length of said lever is varied and the arc of travel of said drive surface is correspondingly varied.

5. The improvement in a strip feeder of claim 4 further characterized in that:

(a) said control means includes an externally threaded shaft on which is mounted an internally threaded adjustment block;
(b) said pivot axis being defined by a pivot shaft which is rotatably mounted in said adjustment block;
(c) rotation of said threaded shaft being effective to move the adjustment block and said axis relative to said lever.

6. The improvement in a strip feeder of claim 5 further characterized by and including:

(a) detente means for releasably preventing rotation of said threaded shaft.

* * * * *